US011596183B2

(12) United States Patent
Morris et al.

(10) Patent No.: US 11,596,183 B2
(45) Date of Patent: Mar. 7, 2023

(54) BREAST SUPPORT GARMENT

(71) Applicant: LULULEMON ATHLETICA CANADA INC., Vancouver (CA)

(72) Inventors: Stephen Thomas Caulton Morris, Shawnigan Lake (CA); Jessica Lee Croll, Pemberton (CA); Rebecca Glazier, New Westminster (CA); Emilie Rastoll, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 417 days.

(21) Appl. No.: 16/750,320

(22) Filed: Jan. 23, 2020

(65) Prior Publication Data

US 2020/0237027 A1 Jul. 30, 2020

Related U.S. Application Data

(60) Provisional application No. 62/796,452, filed on Jan. 24, 2019.

(51) Int. Cl.

| | |
|---|---|
| ***A41C 3/00*** | (2006.01) |
| ***A41D 13/00*** | (2006.01) |
| ***A45F 3/16*** | (2006.01) |

(52) U.S. Cl.

CPC ..... *A41C 3/0057* (2013.01); *A41C 3/0028* (2013.01); *A41C 3/0035* (2013.01); *A41D 13/0012* (2013.01); *A41D 13/0017* (2013.01); *A45F 2003/166* (2013.01)

(58) Field of Classification Search

CPC ..... A45F 2003/166; A41C 3/0057; A41C 3/0028; A41C 3/0035; A41D 13/0017; A41D 13/0012

USPC ..... 450/89

See application file for complete search history.

(56) References Cited

U.S. PATENT DOCUMENTS

| | | | | | |
|---|---|---|---|---|---|
| 4,804,351 | A * | 2/1989 | Raml | A41C 3/02 | 450/71 |
| 4,816,005 | A * | 3/1989 | Braaten | A41C 3/02 | 450/74 |
| 4,825,471 | A * | 5/1989 | Jennings | A41D 27/20 | 2/247 |
| 5,823,851 | A * | 10/1998 | Dicker | A41C 3/0057 | 450/74 |
| 5,864,880 | A * | 2/1999 | Adam | A45F 3/20 | 2/108 |
| 5,938,089 | A * | 8/1999 | Abreu-Marston | A63B 21/0602 | 224/267 |

(Continued)

FOREIGN PATENT DOCUMENTS

| | | | | |
|---|---|---|---|---|
| WO | WO-9824335 | A1 * | 6/1998 | A41D 13/0015 |

*Primary Examiner* — Alissa J Tompkins
*Assistant Examiner* — Brieanna Szafran

(57) ABSTRACT

Examples of a breast support garment are disclosed. The breast support garment comprises a front panel with a chest area configured to support a wearer's breasts and dampen an accelerating movement of the breast tissue, and a hydration system that comprises a hydration reservoir and a dispensing tube connected to the reservoir. The breast support garment further comprises a holder that is dimensioned to receive the reservoir of the hydration system and one or more guides to support the dispensing tube. The breast support garment of the present invention integrates the functions of a high support sports bra and a hydration vest or backpack.

12 Claims, 5 Drawing Sheets

(56) References Cited

U.S. PATENT DOCUMENTS 6,099,382 A * 8/2000 Wilson ..... A41C 3/0057 2/247
6,626,733 B1 * 9/2003 Knutson ..... A41D 13/0012 224/148.1
7,364,491 B2 * 4/2008 Updyke ..... A41D 27/205 450/36
D641,954 S * 7/2011 Glass ..... D2/708
D674,578 S * 1/2013 Glass ..... D2/731
8,833,619 B2 * 9/2014 Chapuis ..... A45F 3/16 224/148.2
9,359,049 B1 * 6/2016 Alexander ..... B63C 9/115
9,456,642 B2 * 10/2016 Lee ..... A41D 15/04
10,023,279 B1 * 7/2018 Alexander ..... A45F 3/16
10,201,192 B1 * 2/2019 Lott ..... A41C 3/02
10,244,800 B1 * 4/2019 Goff ..... A41C 3/122
10,869,510 B1 * 12/2020 Goff ..... A41C 3/0035
10,932,501 B1 * 3/2021 Powell ..... A41C 3/12
D945,124 S * 3/2022 Yancey ..... D2/857
2005/0075047 A1 * 4/2005 Zagame ..... A41C 3/02 450/38
2005/0255789 A1 * 11/2005 Gaudet ..... A41C 3/0085 450/41
2011/0113524 A1 * 5/2011 Sinder ..... A45F 3/20 224/148.1
2011/0177757 A1 * 7/2011 Swendseid ..... A41C 3/0057 2/113
2013/0146623 A1 * 6/2013 Murray ..... A45F 3/18 224/148.1
2014/0013481 A1 * 1/2014 Lee ..... A45F 3/16 2/69
2017/0347729 A1 * 12/2017 Goff ..... A41D 27/20
2018/0332904 A1 * 11/2018 Rendone ..... A41C 3/0035
2019/0098940 A1 4/2019 Huffa et al.

* cited by examiner

BREAST SUPPORT GARMENT

TECHNICAL FIELD

The present disclosure relates to garments for use in active environments where the wearer of such a garment is engaged in an activity incorporating accelerating movements and more particularly relates to sports apparel that combines the support of a high-performance bra and a hydration vest/backpack.

BACKGROUND

During sport activities, such as running, cycling or hiking, athletes require water, food and other essentials that they need to bring with them on their workout. Typical hydration vests and backpacks are designed to provide water to the wearer engaged in the activity; however, such vests may be uncomfortable since they add shoulder and chest straps over the breast area. Traditional hydration vests/backpacks are not designed to address the shape and/or support required for breast motion during sport activities.

Therefore, there is a need for a piece of apparel that integrates the function of a hydration vest or backpack and a sports bra, designed to meet breast biomechanics and form, and to provide movement management of the breast tissue as well as the necessary hydration/nutrition required for the workout.

SUMMARY

In one aspect, a breast support garment is provided. The breast support garment comprises a front panel forming a front portion of the garment and a back panel connected to the front panel forming two arm holes, a neck hole and a torso opening. The front panel comprises a chest area configured to encapsulate the wearer's breasts and absorb or dampen the accelerating movement of the breast tissue during activity. A hydration system that comprises a hydration reservoir and a dispensing tube in fluid communication with an inner cavity of the reservoir is secured at the back panel. At least two straps extend across the shoulders from a top of the front panel to the back panel. The breast support garment further comprises a holder formed at the back panel and dimensioned to receive the reservoir of the hydration system and one or more guiding retainers to support the dispensing tube.

In another aspect, the holder can be designed to provide a storage area for a number of items. The holder comprises an access opening and a means for opening and closing the access opening.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION OF SPECIFIC EMBODIMENTS

The present invention discloses an article of apparel designed for athletes that integrates and combines the functions of a sports bra and a hydration vest or backpack. The hydration and breast support apparel of the present invention can be put over any fitted top or regular (low-support) bra. The hydration and breast support apparel is designed to be worn during activity to give the wearer an additional support or layer over a low-support (comfort) bra or top. After the activity, the hydration and breast support garment can be easily removed leaving the wearer with her/his comfort top. However, the wearer can use the hydration and breast support garment without any under layer (regular bra or top) as it can be used as a sole layer.

Figure 1:
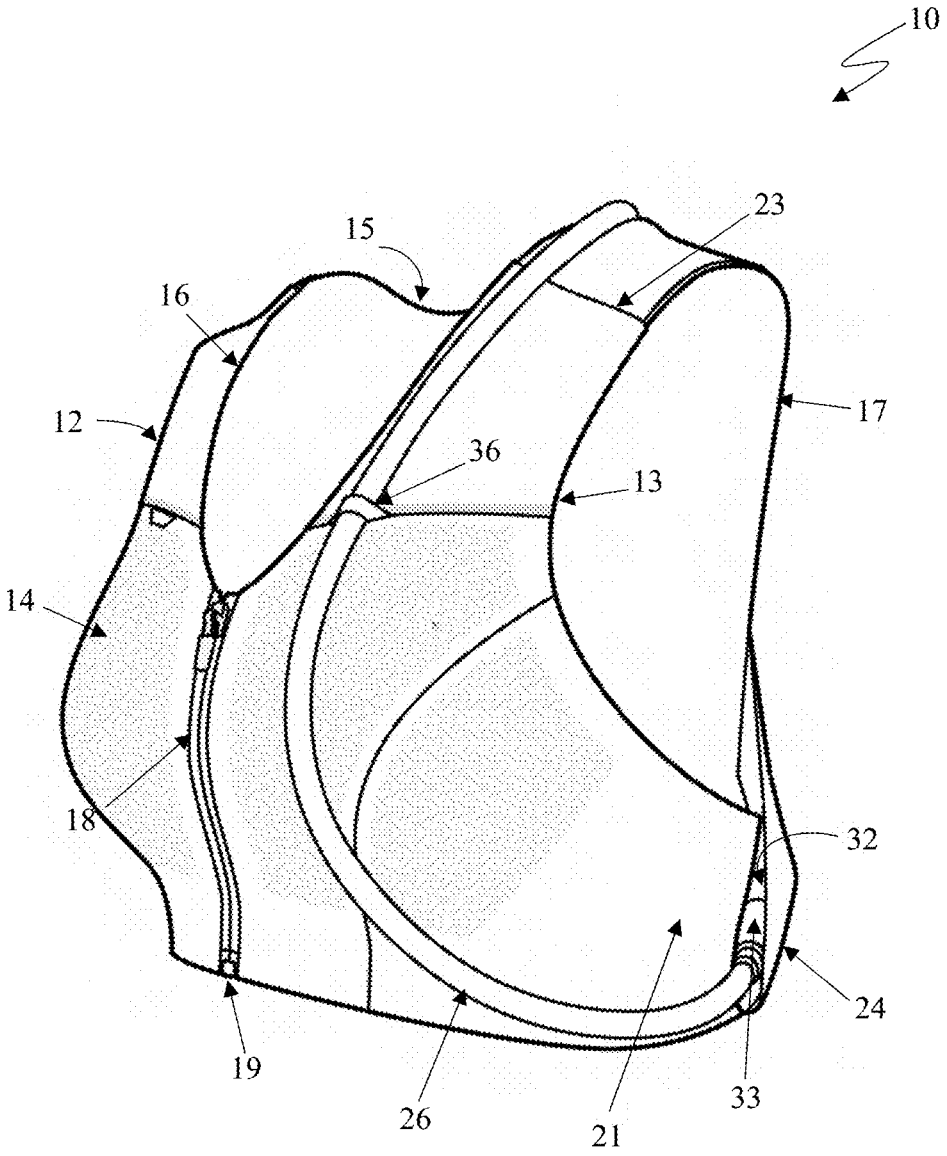
FIG. 1 is a perspective front view of an example of a breast support garment showing a front panel and a portion of a hydration dispensing tube.

FIG. 1 illustrates an example of a breast support apparel/garment 10 having a front panel 12 forming a front portion of the garment covering at least portion of a wearer's chest. A top edge 16 of the front panel 12 forms a neck opening or hole 15 and side edges 13 of the front panel and side edges 17 of a back panel form the respective right and left arm openings.

The front panel 12 comprise a chest area (e.g. two cups 14) that encapsulates each of the wearer's breasts and provides damping support and/or compression for the wearer's breasts. In one embodiment, the cups can have a 3-D shape and can be formed by seaming, sewing, molding, knitting or any other suitable technique or combination thereof. In various embodiments, the front panel 12 can be a flat panel with a chest area 14 that is designed to support and/or reinforce the breast tissue. The front panel 12 can include an outer liner and an inner liner that may be bonded, fused, or glued together. For example, the outer and inner liners can be bonded only at the edge portion, the two liners can be bonded through the entire surface, or a combination thereof. In various embodiments, the front panel 12 can have a decoupling panel (not shown) positioned between the two cups 14 for decoupled movement of the wearer's breasts such that wearer's breasts can move independently from each other. For example, the decoupling panel may be placed between the outer and the inner liner. In various embodiments, specific panels, strips, straps, or portions of the breast support garment 10 may be reinforced or stiffened with additional layers of material to provide additional support and attenuation of the breast accelerating movement. In various embodiments, a slingshot like support structure, as the one described in U.S. Pat. No. 10,609,966 incorporated herein in its entirety, can be provided with the garment 10 to provide additional breast support and reinforcement. In one embodiment, an underband can be added at the lower edge of the front panel 12 (and/or at a lower edge of a back panel) to provide additional support.

A fastener 18 is provided to open and allow the wearer to put on or remove the garment 10. In the illustrated example of the fastener 18 is a zipper that extends from a top edge 16 of the front panel 12 to its lower edge 19 separating the front panel 12 and forming two symmetrical (left and right) front panel sides. A zippered front makes for quick and easy layering and removal of the garment 10. Persons skilled in the art would understand that the fastener 18 can be formed at the front panel or on one (or both) sides 21 of the bra without departing from the scope of the invention. The fastener 18 can be a zipper, a snap, a button, a clip, a buckle, a hook and loop fastener (such as, for example, VELCRO®) or any combination thereof.

Figure 2:
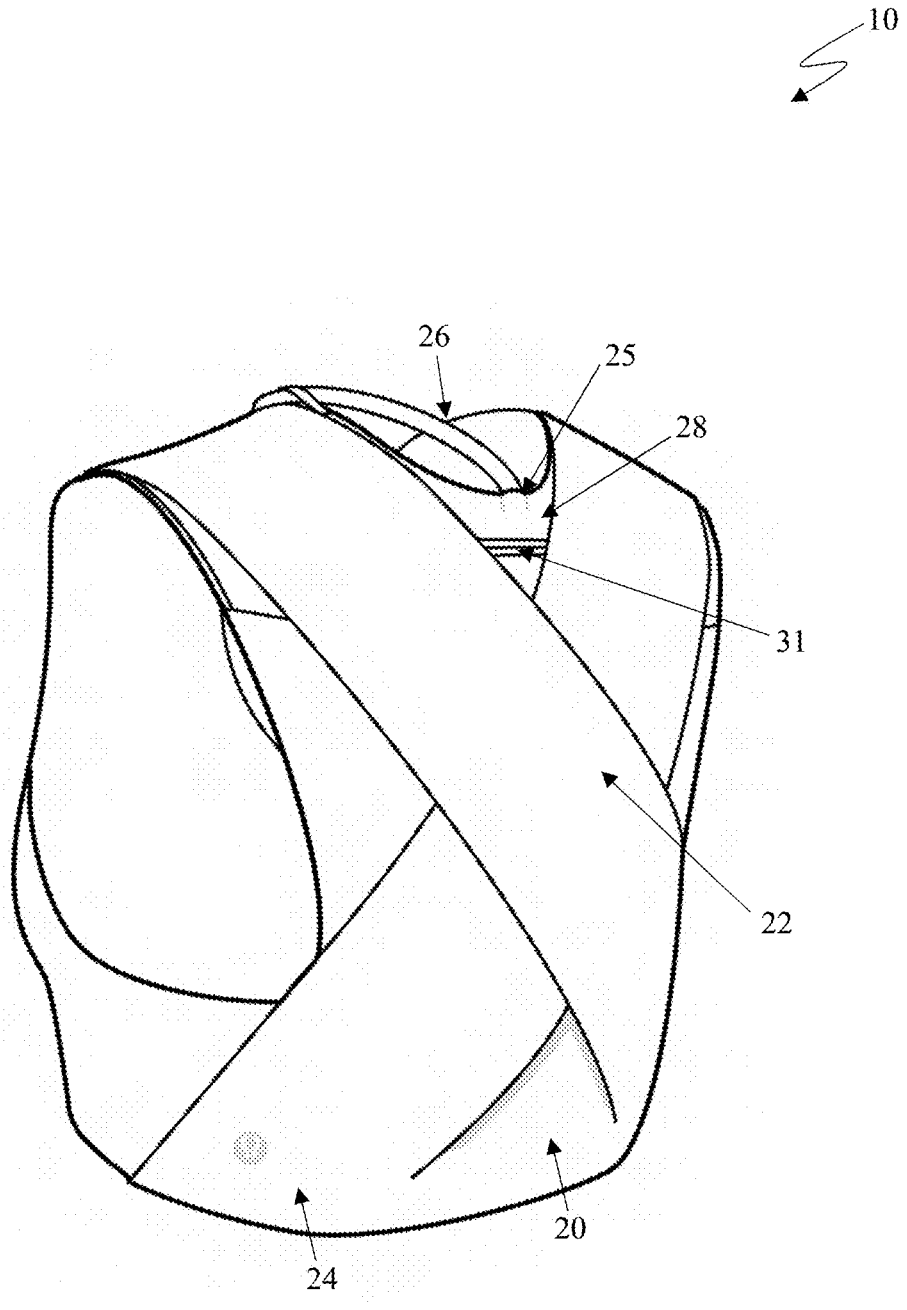
FIG. 2 is a perspective rear view of an example of a breast support garment showing a back panel with two cross straps extending over the back panel.

FIG. 2 is a rear view of the breast support garment 10 showing the back panel 20 and two straps 22. The straps 22 have a front end 23 (see FIG. 1) connected to the top 16 of the front panel and a rear end 24 connected to a lower edge of the back panel 20 and are extending across the shoulders of the wearer. The front body panel 12, the back panel 20 and straps 22 may be made from or include a material or fabric such as nylon with spandex (e.g., ULTRALU®, etc.) or any other suitable material or fabric that is supportive, sweat-wicking and/or breathable. The back panel 20 and/or the straps 22 can also be laminated, comprising inner and outer liners (or in some embodiments additional middle liners) bonded together as described herein above with respect to the front panel 12. The front panel 12 and the back panel 20 can be bonded together (e.g. glued or taped) to create a smooth, seamless fit, and minimize chafing. In one embodiment, the inner liner of the garment 10 can comprise a mesh perforation pattern to soften bounce and add breathability to the garment 10.

Figure 5:
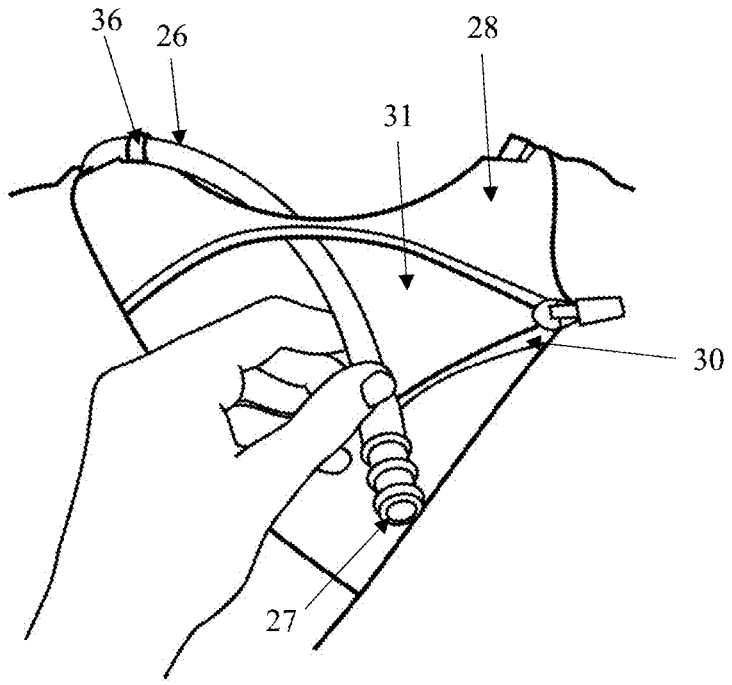
FIG. 5 is a partial back view of a breast support garment showing a portion of the support pocket and a first end of a hydration dispensing tube.

A hydration system that comprises a hydration reservoir (not shown) and a dispensing tube 26 is provided to carry and provide hydration fluids (e.g. water) to the wearer. The reservoir can be a pouch with a wall defining an inner cavity of the reservoir and an access opening to provide an access to the inner cavity of the reservoir. For example, the reservoir can be any type of known hydration reservoirs used with hydration vests or any other known and suitable reservoir. The access opening can be designed to allow an easy and quick re-fill. In addition, the reservoir comprises a connector for connecting the dispensing tube 26 and an on/off switch valve to prevent leaks. The reservoir can be made of a lightweight and durable material, such as for example a thermoplastic polyurethane (TPU) film. The dispensing tube 26 has a first end 27 (see FIG. 5) that is connected to the plugin connector of the reservoir and a second end. A mouthpiece 33 (see FIG. 1) is formed at the second end of the dispensing tube 26. The garment 10 can also include a holder 28 (see FIG. 5) that is formed at the back panel 20 and is dimensioned to receive the hydration reservoir of the hydration system. The holder 28 has an access opening 31 through which the reservoir can be inserted or removed therefrom. The access opening 31 of the holder 28 can be closed by a fastener 30 (see FIG. 5). In the illustrated example of the garment 10, the fastener 30 is a zipper, however, persons skilled in the art would understand that any other known type of fastener (e.g. a button, a buckle, a hook and loop fastener (such as, for example, VELCRO®), etc.) can be used without departing from the scope of the invention. In various embodiments, an elastic on a top edge of the holder 28 or a flap can be used to keep the holder 28 closed. In addition, a securing retainer (not shown) can be provided to secure the hydration reservoir in the holder and prevent its bouncing within the pocket during activity. For example, one or more elastic strips or elastic web-mesh can be provided in the holder 28 to secure the reservoir therein. The holder 28 can further comprise a tube access opening 25 (FIG. 2) so that the dispensing tube can pass through such opening to be connected to the reservoir positioned into the holder 28. The tube access opening 25 can be positioned at the top of the holder, as in the example illustrated in FIG. 2 or at any other suitable position without departing from the scope of the invention.

In various embodiments, the holder 28 can be omitted and the hydration reservoir can be secured to the back panel using a retainer, such as, for example, a number of hooks that are sized and designed to engage a number of respective hook holders. For example, the hooks can be formed at the hydration reservoir and the hook holders can be positioned on the back panel 20 so by engaging the hooks with the respective hook holders the reservoir is secured to the back panel 20. One or more elastic straps can also be used to additionally support the reservoir and keep it close to the back panel 20 and prevent bouncing during activity.

Figure 3:
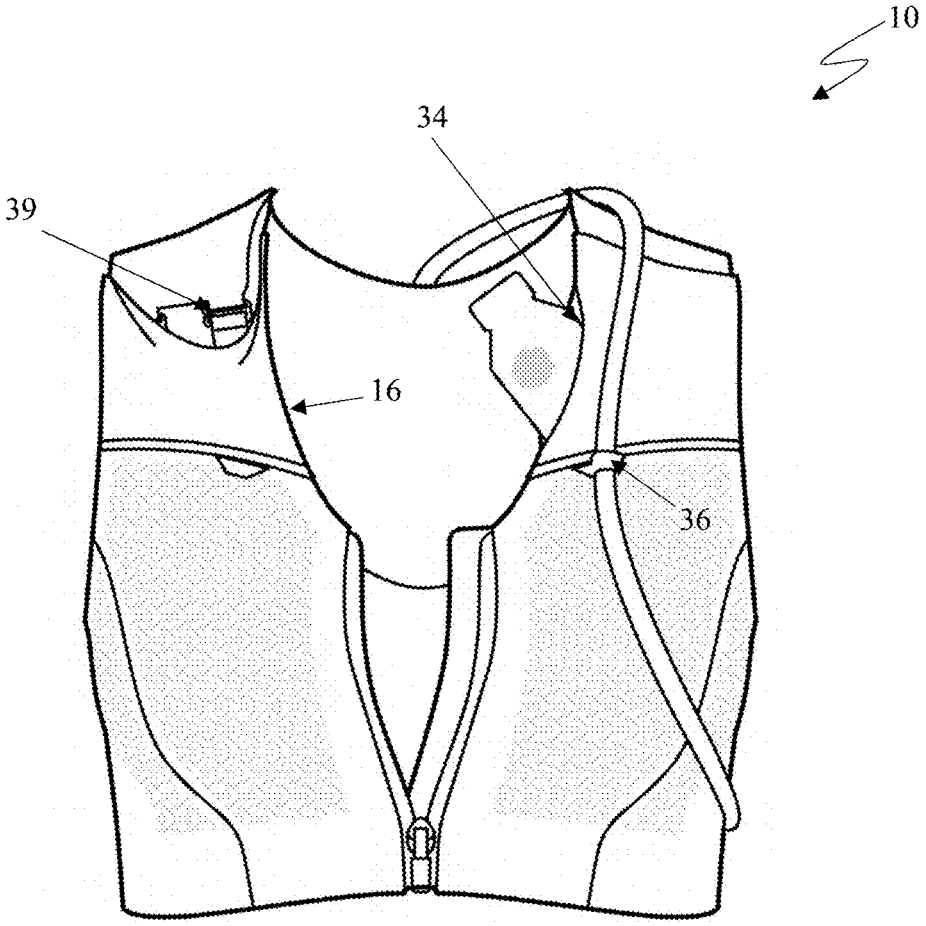
FIG. 3 is front view of an example of a breast support garment showing a fastener at a front panel and a concealed pocket formed in the front panel.

The garment 10 can further include a number of guides 36 (see FIG. 3) for guiding and securing the dispensing tube 26 in place. The guides 36 are positioned and arranged such that they can keep the dispensing tube 26 in place as it extends from the holder 28 at the back through the shoulder to the front of the garment 10. The guides 36 can include, for example, a loop of a stretchable strap (as the loop 36 shown on FIGS. 1, 3 and 5) or a channel formed of a suitable material or a rigid metal/plastic hook. The guides 36 are shaped and sized such that the dispensing tube 26 can pass through or can be held within the guides 36 to keep the dispensing tube 26 in place. For example, the guides (e.g. loops 36) can be positioned on at least one of the shoulders or any other convenient position on the front, side or back of the garment 10.

In various embodiments, the hydration system can be omitted and the holder 28 can be used as a backpack storage for any nutrition or other items that the wearer may need during activity. For example, the holder 28 can be a single storage pocket area or can comprise a number of separate compartments sized and designed to hold various items.

In the illustrated examples of the breast support garment 10, the straps 22 cross over each other. The cross straps 22 can balance the movement between the breasts and the hydration reservoir or stored items as well as to create an additional storage support between the back panel 20 and the straps 22. For example, as shown in FIG. 1, the rear end 24 of the strap 22 and the side panel of the garment forms a stretch panel 32 that can be used to keep the mouthpiece 33 of the dispensing tube 26 securely held therein. In addition, the garment 10 can comprise a number of additional storage pockets placed at the back panel 20, the straps 22 and/or the front panel 12. The additional storage pockets can be concealed, such as for example, a concealed pocket 34 shown in FIG. 3 that can be formed on a top edge 16 of the front panel or at any other convenient position at the front, side or the back of the garment 10 that can be easily reachable by the wearer.

Figure 4:
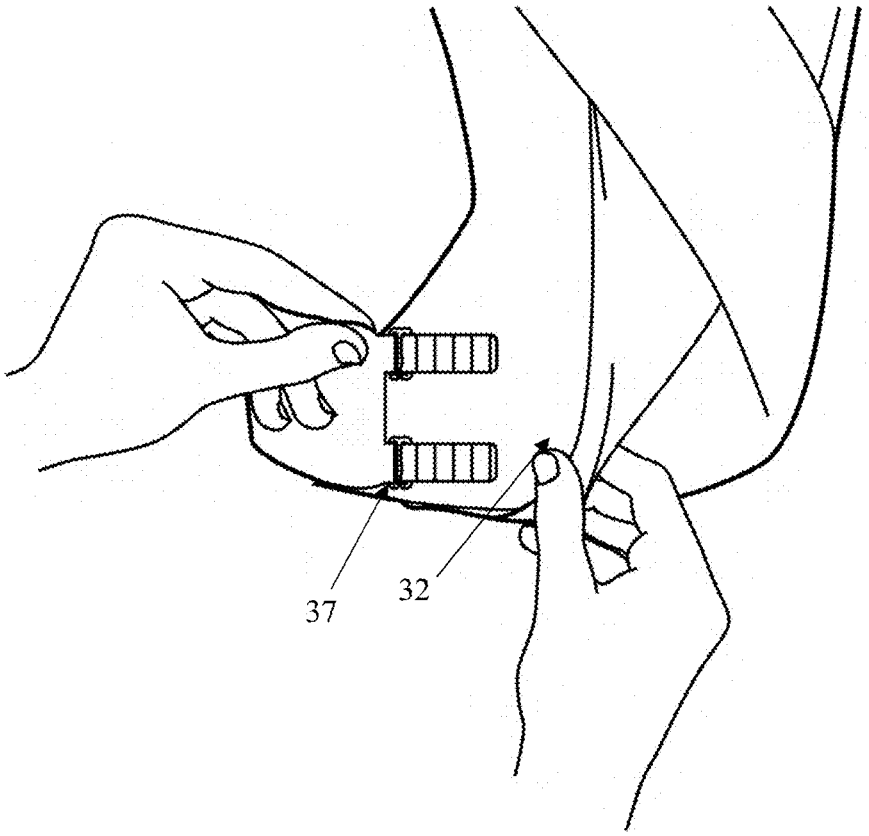
FIG. 4 is a partial side view of a breast support garment showing a side adjuster for fitting the front and the back panel.

The breast support garment 10 can further comprise a side adjuster 37 (see FIG. 4) and a strap adjuster 39 (see FIG. 3) to adjust the fit of the garment and accommodate a cross section of sizes and shapes and increase the adjustability of a standard garment. The side adjuster 37 can be positioned on the side between the front and the back panel 12, 20. The side adjuster 37 can have a first part connected to a lower portion of the front panel 12 and a second part, facing the first part and positioned on a lower portion of the back panel 20. For example, the first part can be a strip with a hook at its end and the second part can comprise a number of loops in the case where a hook and loop type of adjuster is used, however any other suitable type of adjustor or fastener can be used without departing from the scope of the invention in order to fit the front 12 and back 20 panels of the garment 10. The side adjuster 37 can be positioned on one or both sides of the breast support apparel. The strap adjuster 39 is positioned on each of the straps 22 to adjust the length of the straps. The side and strap adjusters 37, 39 can be concealed. For example, the side adjuster 37 can be concealed by the stretch panel 32 (see FIG. 4) and the strap adjuster 39 can be concealed by, for example, a strategically-placed storage pocket or panel (see FIG. 3). The breast support garment 10 can further include a number of subtle front and back reflective elements to increase the visibility of the wearer.

While particular elements, embodiments and applications of the present disclosure have been shown and described, it will be understood that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

The invention claimed is:

1. A breast support garment comprising:

a front panel forming a front portion of the garment comprising a chest area configured to support a wearer's breast and dampen an accelerating movement of the breast tissue;

a back panel forming a back portion of the garment, the back panel connected to the front panel and forming two arm holes, a neck opening and a torso opening;

a hydration system comprising a hydration reservoir secured to the back panel and a dispensing tube having a first end connected to the hydration reservoir and a mouth piece formed at an opposite end;

a holder formed at the back panel and having an access opening and a fastener for opening and closing the access opening, the holder being dimensioned to receive the hydration reservoir;

a fastener configured to open to allow the wearer to put on or remove the garment; and two straps, each of the two straps having a front end connected to a top side of the front panel and a rear end connected to a lower edge of the back panel, the two straps configured to extend across shoulders of the wearer and over the back panel and hydration system.

2. The breast support garment of claim 1, wherein the at least two straps are crossed.

3. The breast support garment of claim 1, wherein the holder further comprises a securing retainer to secure the hydration reservoir when positioned in the holder.

4. The breast support garment of claim 1, further comprising one or more retainers to secure the hydration reservoir to the back panel.

5. The breast support garment of claim 1, further comprising one or more guides to support the dispensing tube.

6. The breast support garment of claim 5, wherein the guides include one or more loops of a stretchable strap arranged to guide the dispensing tube from the hydration reservoir at the back panel through a shoulder to the front panel.

7. The breast support garment of claim 1, wherein the front panel further comprises an inner liner and an outer liner, the inner liner and the outer liner being at least partially bonded together.

8. The breast support garment of claim 7, further comprising at least one middle layer formed between the front and the back panels, the middle layer configured to provide additional support to a root of the breast tissue.

9. The breast support garment of claim 1 further comprising an underband at a lower edge of the front and the back panels to provide additional breast support.

10. The breast support garment of claim 1, further comprising a strap adjuster positioned at each of the two straps and configured to adjust the length of each of the two straps.

11. The breast support garment of claim 1, further comprising a side adjuster having a first part connected to a lower portion of the front panel and a second part positioned on a lower portion of the back panel and facing the first part, the side adjuster being configured to fit the front and back panels.

12. The breast support garment of claim 11, further comprising a stretch panel concealing the side adjuster and forming a storage pocket.

* * * * *